US010840048B2

(12) United States Patent
Easton et al.

(10) Patent No.: US 10,840,048 B2
(45) Date of Patent: Nov. 17, 2020

(54) MODULAR GROUND FAULT PROTECTIVE RELAY AND PROTECTION MODULE THEREFOR

(71) Applicant: EATON CORPORATION, Cleveland, OH (US)

(72) Inventors: Jason Easton, Williamsburg, VA (US); Paul Seff, Williamsburg, VA (US); Jeffery Kuykendall, Williamsburg, VA (US); Michel Rivas, Miami, FL (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 805 days.

(21) Appl. No.: 15/457,055

(22) Filed: Mar. 13, 2017

(65) Prior Publication Data

US 2018/0261994 A1 Sep. 13, 2018

(51) Int. Cl.

| | |
|---|---|
| ***H01H 83/02*** | (2006.01) |
| ***H01H 71/04*** | (2006.01) |
| ***H01H 71/08*** | (2006.01) |

(52) U.S. Cl.

CPC ..... *H01H 83/02* (2013.01); *H01H 71/04* (2013.01); *H01H 71/082* (2013.01); *H01H 2071/086* (2013.01)

(58) Field of Classification Search

CPC ..... H01H 83/02; H01H 71/082; H01H 71/04; H01H 2071/086

USPC ..... 361/42

See application file for complete search history.

(56) References Cited

U.S. PATENT DOCUMENTS

2014/0211345 A1* 7/2014 Thompson ..... B60L 53/68 361/42

OTHER PUBLICATIONS

Bender the Power in Electrical Safety, RCMS460 and RCMS490 Series, "Digital Multi-Channel Ground Fault Monitor / Ground Fault Relay Grounded and High-Resistance Grounded AC/DC Systems", 10 Pages, bender.org, Coatesville, PA (USA) and Mississauga, ON (Canada).

"Motor Protection and Monitoring Monitoring Relays"; 51 Pages; V5-T5-52 vol. 5; Power Control Products CA033001EN—Jan. 2017 www.eatoncanada.ca.

* cited by examiner

*Primary Examiner* — Dharti H Patel

(74) *Attorney, Agent, or Firm* — Eckert Seamans Cherin & Mellott, LLC

(57) ABSTRACT

A protection module is for a modular ground fault protective relay. The modular ground fault protective relay includes a power supply module having a connection port. The protection module includes a body having a first side and a second side disposed opposite the first side, a module connector extending outwardly from the first side, the module connector being structured to be removably coupled to the connection port of the power supply module, and a module expansion port extending inwardly from the second side toward the first side.

19 Claims, 3 Drawing Sheets

MODULAR GROUND FAULT PROTECTIVE RELAY AND PROTECTION MODULE THEREFOR

BACKGROUND

Field

The disclosed concept relates to modular ground fault protective relays. The disclosed concept also relates to protection modules for modular ground fault protective relays.

Background Information

Ground fault relays are employed in a number of electrical systems (e.g., without limitation, systems having panelboards for distribution pedestals for marine and recreational vehicles, hydraulic pumps, motors, and/or waste water treatment apparatus) to provide ground fault circuit protection. Current ground fault relays are available either as a single circuit protective unit capable of protecting a single circuit, or, as a multi-circuit protective unit that is capable of protecting a large number of circuits (e.g., twelve circuits). Known multi-circuit ground fault relays present a relatively expensive and unnecessary solution when only a few circuits require protection.

There is thus room for improvement in ground fault protective relays and protection modules therefor.

SUMMARY

These needs and others are met by embodiments of the disclosed concept, which are directed to a modular ground fault protective relay and protection module therefor.

In accordance with one aspect of the disclosed concept, a protection module is provided for a modular ground fault protective relay. The modular ground fault protective relay includes a power supply module having a connection port. The protection module includes a body having a first side and a second side disposed opposite the first side, a module connector extending outwardly from the first side, the module connector being structured to be removably coupled to the connection port of the power supply module, and a module expansion port extending inwardly from the second side toward the first side.

In accordance with another aspect of the disclosed concept, a modular ground fault protective relay comprises a power supply module having connection port; and a protection apparatus comprising a number of protection modules, one of the number of protection modules comprising a body having a first side and a second side disposed opposite the first side, a module connector extending outwardly from the first side, the module connector being removably coupled to the connection port of the power supply module, and a module expansion port extending inwardly from the second side toward the first side.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the statement that two or more parts are "coupled" or "connected" together shall mean that the parts are joined together either directly or joined through one or more intermediate parts.

As employed herein, the term "number" shall mean one or an integer greater than one (i.e., a plurality).

As employed herein, the statement that two or more parts or components "engage" one another shall mean that the parts exert a force against one another either directly or through one or more intermediate parts or components.

Figure 1:
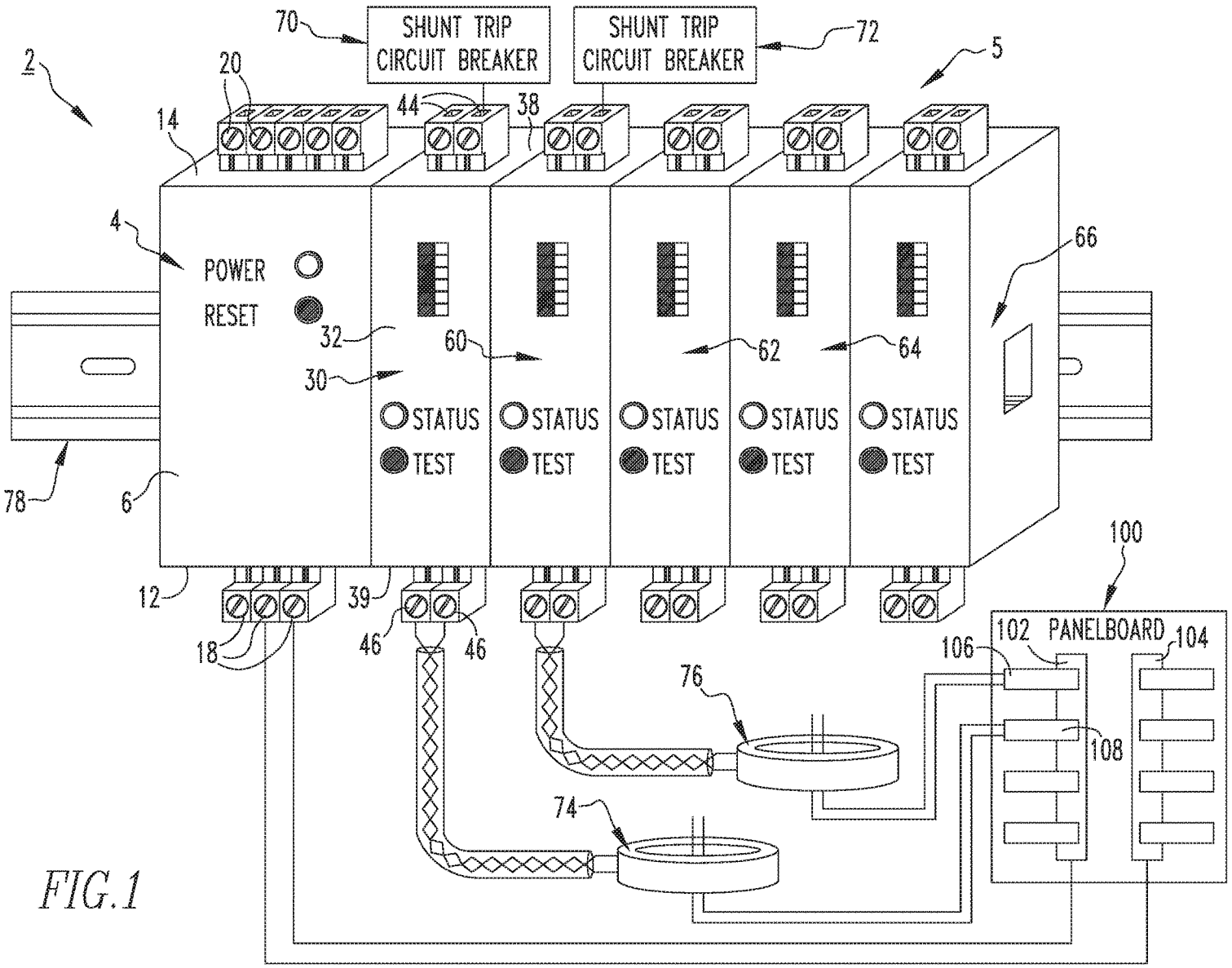
FIG. 1 is a simplified view of a modular ground fault protective relay and protection module therefor, shown with a panelboard, in accordance with one non-limiting embodiment of the disclosed concept.

FIG. 1 is a simplified view of a modular ground fault protective relay 2, in accordance with one non-limiting embodiment of the disclosed concept. The example modular ground fault protective relay 2 includes a power supply module 4 and a protection apparatus 5 including a number of protection modules 30,60,62,64,66. Although five example protection modules 30,60,62,64,66 are shown in FIG. 1, it will be appreciated that any suitable alternative predetermined number of protection modules may be employed with the power supply module 4, in accordance with embodiments of the disclosed concept. As will be discussed in greater detail below, the modular ground fault protective relay 2 provides a novel mechanism to provide ground fault protection to an electrical system (e.g., without limitation, a system including panelboard 100, shown in simplified form in FIG. 1). More specifically, the modular ground fault protective relay 2 is advantageously able to provide ground fault protection to any predetermined number of branch circuits without requiring excessive numbers of protection modules. That is, the modular ground fault protective relay 2 may employ only one single protection module 30 to protect a single branch circuit, or may employ any predetermined number of other protection modules to protect a corresponding number of other branch circuits.

The protection apparatus 5 further includes a number of electrical switching apparatus (two example shunt trip circuit breakers 70,72 are shown in simplified form in FIG. 1) and a number of current transformers (two example current transformers 74,76 are shown in simplified form in FIG. 1). The modular ground fault protective relay 2 further includes a mounting member (e.g., without limitation, DIN rail 78). The example panelboard 100 includes a number of bus bars (two example bus bars 102,104 are shown in simplified form in FIG. 1) and a number of branch circuits (two example branch circuits 106,108 are indicated with reference numerals).

Figure 2:
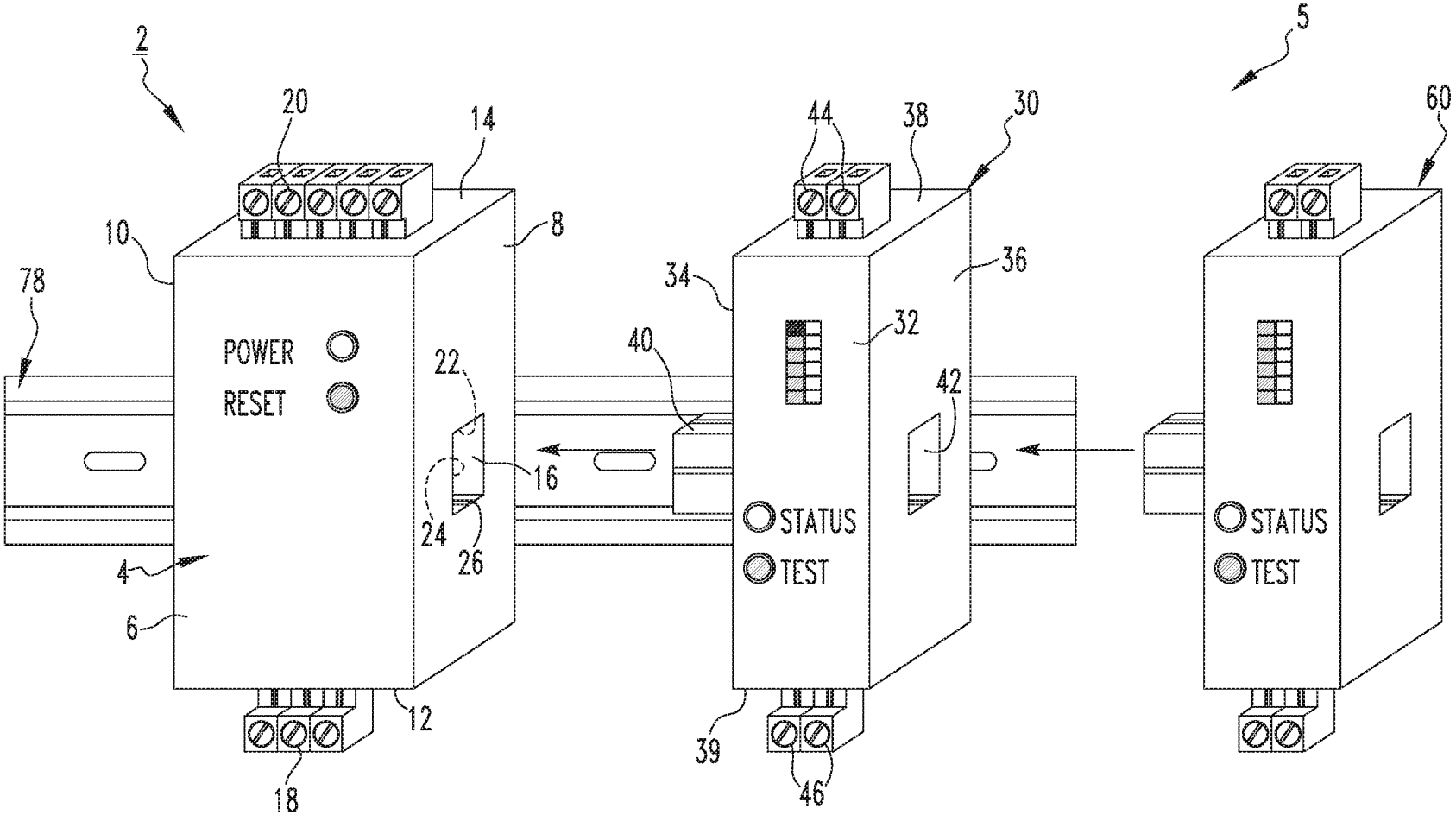
FIG. 2 is an exploded isometric view of a portion of the modular ground fault protective relay and protection module therefor of FIG. 1.

Referring to FIG. 2, the power supply module 4 includes a body 6 having a first side 8, a second side 10 opposite the first side 8, and third and fourth sides 12,14 extending from the first side 8 to the second side 10. The power supply module 4 further has a connection port 16 extending inwardly from the first side 8 toward the second side 10, a number of control power terminals 18 coupled to the third side 12, and a number of external indication terminals 20 coupled to the fourth side 14. The control power terminals 18 are electrically connected with the bus bars 102,104 (FIG. 1) in order to allow the power supply module 4 to provide control power to the entire system (e.g., without limitation, to the protection modules 30,60,62,64,66). The external indication terminals 20 provide an indication to a user that a fault condition has occurred such as, for example, when one of the protection modules 30,60,62,64,66 detects a fault condition.

Continuing to refer to FIG. 2, the protection module 30 includes a body 32 having a first side 34, a second side 36 opposite the first side 34, and third and fourth sides 38,39 extending from the first side 34 to the second side 36. The protection module 30 further has a module connector 40 extending outwardly from the first side 34 away from the second side 36, a module expansion port 42 extending inwardly from the second side 36 toward the first side 34, a number of trip output terminals 44 coupled to the third side 38, and a number of transformer terminals 46 coupled to the fourth side 39. It will be appreciated that each of the other protection modules 60,62,64,66 is preferably structured substantially the same as the protection module 30, however for ease of illustration and economy of disclosure, reference numerals have only been provided for the protection module 30.

Referring again to FIG. 1, each of the shunt trip circuit breakers 70,72 is electrically connected with a corresponding one of the protection modules 30,60 via the trip output terminals 44 (i.e., and the trip output terminals of the protection module 60). Each of the current transformers 74,76 is electrically connected with a corresponding one of the protection modules 30,60 via the transformer terminals 46 (i.e., and the transformer terminals of the protection module 60). As seen, each of the branch circuits 106,108 terminates proximate (i.e., via wires extending through) a corresponding one of the current transformers 74,76 in order to allow the corresponding protection modules 30,60 to sense ground fault current in the corresponding branch circuits 106,108. Accordingly, if/when one of the protection modules 30,60 senses a fault condition in one of the branch circuits 106,108, the corresponding protection module 30,60 causes a corresponding one of the shunt trip circuit breakers 70,72 to trip in order to provide ground fault protection to the corresponding branch circuit 106,108. Although the disclosed concept is being described in association with the protection modules 30,60, the shunt trip circuit breakers 70,72, the current transformers 74,76, and the branch circuits 106,108, it will be appreciated that the protection modules 62,64,66 (i.e., and/or any suitable number of alternative protection modules) may provide ground fault protection to any corresponding number of branch circuits in substantially the same manner as the protection modules 30,60.

Figure 3:
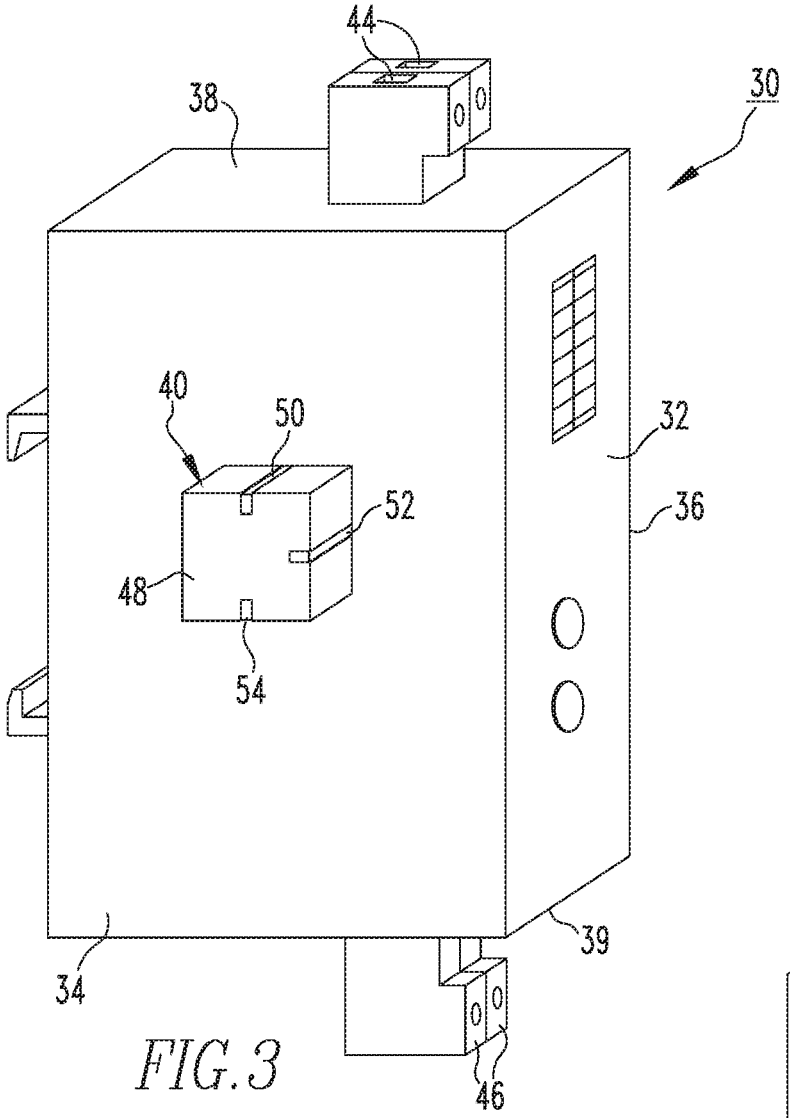
FIG. 3 is another isometric view of the side of one of the protection modules of FIG. 2.

Referring to FIG. 3, it will be appreciated that the module connector 40 of the example protection module 30 is preferably a male connector portion 40, and includes an insulative member 48 and a number of conductive bus members (e.g., without limitation, power bus member 50, neutral bus member 52, and fault bus member 54) each coupled to the insulative member 48. In one example embodiment, the bus members 50,52,54 are each electrically conductive contacts (e.g., without limitation, copper traces). The insulative member 48 is preferably a single unitary component made of a single piece of material, and advantageously insulates each of the bus members 50,52,54 from each other.

Referring again to FIG. 2, the connection port 16 is preferably a female connector portion (i.e., generally defines an opening to receive a corresponding male connector portion), and likewise includes a power bus member (extending generally from location 22 inwardly from the first side 8), a neutral bus member (extending generally from location 24 inwardly from the first side 8), and a fault bus member 26. In operation, when the module connector 40 is inserted into the connection port 16, the power bus members 50 (and the power bus member of the connection port 16) slidably engage one another, the neutral bus members 52 (and the neutral bus member of the connection port 16) slidably engage one another, and the fault bus members 54,26 slidably engage one another.

Figure 4:
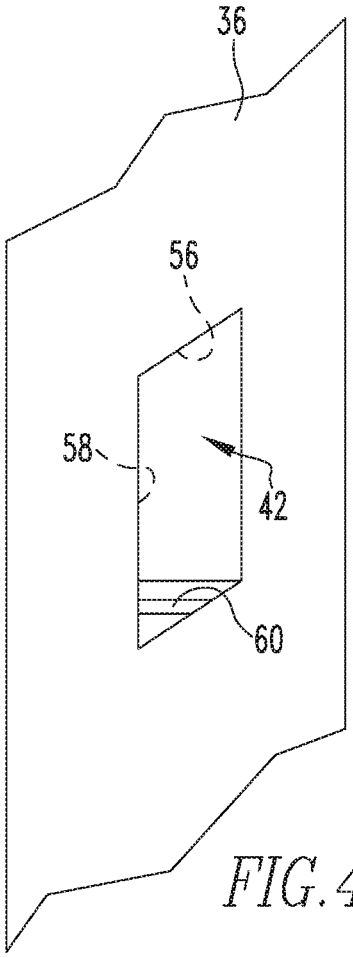
FIG. 4 is an enlarged view of a portion of one of the protection modules of FIG. 2.

FIG. 4 shows an enlarged view of the module expansion port 42. It will be appreciated that the module expansion port 42 is a female connector portion (i.e., generally defines an opening to receive a corresponding male connector portion), and likewise includes a power bus member (extending generally from location 56 inwardly from the second side 36, a neutral bus member (extending generally from location 58 inwardly from the second side 36), and a fault bus member 60. Referring again to FIG. 2, the power bus member, neutral bus member, and fault bus member of the module connector of the protection module 60 each slidably engage a corresponding one of the power bus member, neutral bus member, and fault bus member 60 of the module expansion port 42 of the protection module 30.

Moreover, the power bus members of each of the connection port 16, and the module connectors 40 and module expansion ports 42 of the protection modules 30,60,62,64,66 are electrically connected with each other. The neutral bus members of each of the connection port 16, and the module connectors 40 and module expansion ports 42 of the protection modules 30,60,62,64,66 are electrically connected with each other. The fault bus members of each of the connection port 16, and the module connectors 40 and module expansion ports 42 of the protection modules 30,60, 62,64,66 are electrically connected with each other.

In accordance with the disclosed concept, while the power supply module 4 and the protection module 30 (i.e., and also the protection modules 60,62,64,66) are each mounted to (i.e., coupled to) the DIN rail 78, the slidable engagement between the module connector 40 and the connection port 16 is preferably the only mechanism by which the protection module 30 is coupled to the power supply module 4. More specifically, as discussed above, the module connector 40 slidably engages and is located internal with respect to (i.e., is plugged into) the connection port 16 in order to be removably coupled to the connection port 16. Similarly, the slidable engagement between the module connector of the protection module 60 and the module expansion port 42 is preferably the only mechanism by which the protection module 60 is coupled to the protection module 30. That is, the module connector of the protection module 60 is located internal with respect to and slidably engages (i.e., is plugged into) the module expansion port 42 of the protection module 30 in order to be removably coupled to the protection module 30. In other words, separate fasteners and/or other coupling mechanisms are preferably not needed to couple the power supply module 4 to the protection module 30, or to couple the protection module 30 to the protection module 60. Stated differently, the disclosed concept provides for a quick and inexpensive solution whereby any desired number of protection modules can readily be slid onto either the power supply module 4 and/or each other.

Additionally, all of the power bus members 50 (i.e., and the power bus members of the connection port 16, the module expansion port 42, and like components of the other protection modules 60,62,64,66) are parallel to each other and aligned with each other, all of the neutral bus members 52 (i.e., and the neutral bus members of the connection port 16, the module expansion port 42, and like components of the protection modules 60,62,64,66) are parallel to each other and aligned with each other, and all of the fault bus members 54 (i.e., and the fault bus members of the connection port 16, the module expansion port 42, and like components of the protection modules 60,62,64,66) are parallel to each other and aligned with each other. In this manner, responsive to a fault condition in any one of the branch circuits 106,108 (FIG. 1), the corresponding fault bus members provide an indication to the external indication terminals 20 (FIG. 1) of the power supply module 4 to signal to an operator that a fault has occurred. Similarly, the power bus members allow the power supply module 4 to supply power to each of the protection modules 30,60,62,64,66.

Furthermore, the connection between the protection modules 60,62,64,66 (i.e., the connection between the protection modules 60 and 62, the connection between the protection modules 62 and 64, and the connection between the protection modules 64 and 66) is the same as the connection between the protection modules 30 and 60, discussed above. As such, the modular ground fault protective relay 2 provides a novel mechanism by which any predetermined number of protection modules can be employed with a power supply module in order to provide ground fault circuit protection to a given number of branch circuits. This is advantageous when protection is needed for only a few (e.g., 2, 3, or 4) circuits, or for a predetermined large number of circuits (i.e., 9). Prior art solutions (not shown) are inefficient and/or are relatively expensive in that they provide circuit protection to either one single circuit, or, to a fixed, and relatively large, number of other circuits (e.g., to 12 circuits). Thus, the disclosed concept is efficient and relatively inexpensive in that an operator can readily preset the number of protection modules to correspond to the number of branch circuits in need of protection by simply plugging on the desired number of protection modules to the power supply module. Thus, extra protection modules will not be wasted.

Accordingly, it will be appreciated that the disclosed concept provides for an improved (e.g., without limitation, more versatile, efficient, and less expensive) modular ground fault protective relay 2 and protection module 30,60,62,64,66 therefor, in which the modular ground fault protective relay 2 is advantageously able to protect any preset number of branch circuits without requiring excess protection modules.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A protection module for a modular ground fault protective relay, said modular ground fault protective relay comprising a power supply module having a connection port, said protection module comprising:

a body having a first side and a second side disposed opposite said first side;

a module connector extending outwardly from said first side, said module connector being structured to be removably coupled to said connection port of said power supply module;

a module expansion port extending inwardly from said second side toward said first side; and wherein said module connector comprises an insulative member and a number of bus members each coupled to said insulative member.

2. The protection module of claim 1 wherein said number of bus members comprises a power bus member, a neutral bus member, and a fault bus member each insulated from one another.

3. The protection module of claim 2 wherein said module expansion port comprises a power bus member, a neutral bus member, and a fault bus member each aligned with a corresponding one of said power bus member of said module connector, said neutral bus member of said module connector, and said fault bus member of said module connector.

4. A protection module for a modular ground fault protective relay, said modular ground fault protective relay comprising a power supply module having a connection port, said protection module comprising:

a body having a first side and a second side disposed opposite said first side;

a module connector extending outwardly from said first side, said module connector being structured to be removably coupled to said connection port of said power supply module;

a module expansion port extending inwardly from said second side toward said first side; and wherein said body further has a third side and a fourth side disposed opposite said third side; wherein said third side and said fourth side extend from said first side to said second side; and wherein said protection module further comprises a number of trip output terminals coupled to said third side.

5. The protection module of claim 4 wherein said protection module further comprises a number of transformer terminals coupled to said fourth side.

6. A protection module for a modular ground fault protective relay, said modular ground fault protective relay comprising a power supply module having a connection port, said protection module comprising:

a body having a first side and a second side disposed opposite said first side;

a module connector extending outwardly from said first side, said module connector being structured to be removably coupled to said connection port of said power supply module;

a module expansion port extending inwardly from said second side toward said first side; and wherein said module connector is structured to engage and be disposed internal with respect to said connection port; and wherein the engagement between said module connector and said connection port is the only mechanism by which said protection module is structured to be coupled to said power supply module.

7. A modular ground fault protective relay comprising:

a power supply module having connection port; and a protection apparatus comprising a number of protection modules, one of said number of protection modules comprising:

a body having a first side and a second side disposed opposite said first side, a module connector extending outwardly from said first side, said module connector being removably coupled to said connection port of said power supply module, and a module expansion port extending inwardly from said second side toward said first side;

wherein said module connector is received in the connection port, such reception being the only mechanism by which said one of said number of protection modules is coupled to said power supply module.

8. The modular ground fault protective relay of claim 7 wherein said number of protection modules further comprises another protection module comprising:

a body having a third side and a fourth side disposed opposite said third side;

a module connector extending outwardly from said third side, said module connector of said another protection module being removably coupled to said module expansion port of said one of said number of protection modules; and a module expansion port extending inwardly from said fourth side toward said third side.

9. The modular ground fault protective relay of claim 8 wherein said number of protection modules further comprises a plurality of other protection modules each structured substantially the same as said another protection module; and wherein each of said plurality of other protection modules is removably coupled to at least one of said another protection module and another one of said plurality of other protection modules.

10. The modular ground fault protective relay of claim 7 wherein said power supply module comprises a body having a side; and wherein said connection port extends from said side inwardly with respect to said body of said power supply module.

11. A modular ground fault protective relay comprising:

a power supply module having connection port; and a protection apparatus comprising a number of protection modules, one of said number of protection modules comprising:

a body having a first side and a second side disposed opposite said first side, a module connector extending outwardly from said first side, said module connector being removably coupled to said connection port of said power supply module, and a module expansion port extending inwardly from said second side toward said first side;

wherein said number of protection modules further comprises another protection module comprising:

a body having a third side and a fourth side disposed opposite said third side;

a module connector extending outwardly from said third side, said module connector of said another protection module being removably coupled to said module expansion port of said one of said number of protection modules; and a module expansion port extending inwardly from said fourth side toward said third side; and wherein said module connector of said another protection module engages and is disposed internal with respect to said module expansion port of said one of said number of protection modules; and wherein the engagement between said module connector of said another protection module and said module expansion port of said one of said number of protection modules is the only mechanism by which said one of said number of protection modules is coupled to said another protection module.

12. A modular ground fault protective relay comprising:

a power supply module having connection port; and a protection apparatus comprising a number of protection modules, one of said number of protection modules comprising:

a body having a first side and a second side disposed opposite said first side, a module connector extending outwardly from said first side, said module connector being removably coupled to said connection port of said power supply module, and a module expansion port extending inwardly from said second side toward said first side; and wherein said power supply module comprises a number of control power terminals and a body having a side, another side, and a further side disposed opposite said another side; wherein said connection port extends inwardly from said side; wherein said side extends between said another side and said further side; and wherein said number of control power terminals are coupled to said another side.

13. The modular ground fault protective relay of claim 12 wherein said power supply module further comprises a number of external indication terminals coupled to said further side.

14. A modular ground fault protective relay comprising:

a power supply module having connection port; and a protection apparatus comprising a number of protection modules, one of said number of protection modules comprising:

a body having a first side and a second side disposed opposite said first side, a module connector extending outwardly from said first side, said module connector being removably coupled to said connection port of said power supply module, and a module expansion port extending inwardly from said second side toward said first side; and wherein said one of said number of protection modules further comprises a number of trip output terminals coupled to said body; and wherein said protection apparatus further comprises a shunt trip circuit breaker electrically connected to at least one of said number of trip output terminals.

15. The modular ground fault protective relay of claim 14 wherein said one of said number of protection modules further comprises a number of transformer terminals coupled to said body; and wherein said protection apparatus further comprises a current transformer electrically connected with at least one of said number of transformer terminals.

16. A modular ground fault protective relay comprising:

a power supply module having connection port; and a protection apparatus comprising a number of protection modules, one of said number of protection modules comprising:

a body having a first side and a second side disposed opposite said first side, a module connector extending outwardly from said first side, said module connector being removably coupled to said connection port of said power supply module, and a module expansion port extending inwardly from said second side toward said first side; and wherein said module connector and said connection port each comprise a power bus member, a neutral bus member, and a fault bus member; wherein said power bus member of said module connector slidably engages said power bus member of said connection port; wherein said neutral bus member of said module connector slidably engages said neutral bus member of said connection port; and wherein said fault bus member of said module connector slidably engages said fault bus member of said connection port.

17. The modular ground fault protective relay of claim 16 wherein said module connector engages and is disposed internal with respect to said connection port.

18. A modular ground fault protective relay comprising:

a power supply module having connection port; and a protection apparatus comprising a number of protection modules, one of said number of protection modules comprising:

a body having a first side and a second side disposed opposite said first side, a module connector extending outwardly from said first side, said module connector being removably coupled to said connection port of said power supply module, and a module expansion port extending inwardly from said second side toward said first side;

wherein said power supply module comprises a body having a third side;

wherein said connection port extends from said third side inwardly with respect to said body of said power supply module; and wherein said connection port comprises a power bus member, a neutral bus member, and a fault bus member each electrically insulated from one another.

19. A modular ground fault protective relay comprising:

a power supply module having connection port; and a protection apparatus comprising a number of protection modules, one of said number of protection modules comprising:

a body having a first side and a second side disposed opposite said first side, a module connector extending outwardly from said first side, said module connector being removably coupled to said connection port of said power supply module, and a module expansion port extending inwardly from said second side toward said first side;

wherein said module connector engages and is disposed internal with respect to said connection port; and wherein the engagement between said module connector and said connection port is the only mechanism by which said one of said number of protection modules is coupled to said power supply module.

* * * * *